US006588875B1

(12) United States Patent
Kleinhammer

(10) Patent No.: US 6,588,875 B1
(45) Date of Patent: Jul. 8, 2003

(54) INK JET CARTRIDGE PRINTHEAD SEAL

(76) Inventor: John W. Kleinhammer, 1000 Park Ave., Cayucos, CA (US) 93430

( * ) Notice: Subject to any disclaimer, the term of this patent is extended or adjusted under 35 U.S.C. 154(b) by 80 days.

(21) Appl. No.: 10/007,050

(22) Filed: Dec. 4, 2001

(51) Int. Cl.[7] ..... B41J 2/165
(52) U.S. Cl. ..... 347/29
(58) Field of Search ..... 347/29, 22

(56) References Cited

U.S. PATENT DOCUMENTS 5,262,802 A 11/1993 Karita et al.
5,373,936 A 12/1994 Kawai et al.
5,400,060 A 3/1995 Carlotta
5,648,802 A 7/1997 Abe
5,781,208 A 7/1998 Karita et al.
5,805,181 A 9/1998 Tanaka et al.
5,850,238 A * 12/1998 Karita et al. ..... 347/29
5,926,196 A 7/1999 Sawicki et al.
6,062,683 A 5/2000 Kawakami et al.
6,074,037 A 6/2000 Nakahara et al.
6,199,973 B1 3/2001 Bartolome et al.
6,328,411 B1 * 12/2001 Taylor et al. ..... 347/29

OTHER PUBLICATIONS

Front page: R–Jet Tek Catalog 106; internet screen image including internet address and date; full page 17 print illustrating Cartridge Transport Clips.

* cited by examiner

*Primary Examiner*—Thinh Nguyen

(57) ABSTRACT

An ink jet cartridge printhead seal to prevent ink from drying when refilled, stored, shipped or removed from a printer comprising a sheet of flexible material (20) having an adhensive (21) coating secured to an elastomeric seal (10) for sealing a printhead (32) nozzle plate (34), said flexible material and said seal is protected with a release liner (24) covering said adhesive on said flexible material, with a finger tab(40) secured near one end of said flexible material.

3 Claims, 5 Drawing Sheets

INK JET CARTRIDGE PRINTHEAD SEAL

FEDERALLY SPONSORED RESEARCH

Not Applicable

SEQUENCE LISTING OR PROGRAM

Not Applicable

BACKGROUND

1. Field of Invention

This invention relates to ink jet cartridge printhead seals, specifically to such seals that are for sealing the printhead when refilled, shipped, stored or removed from a printer.

2. Description of Prior Art

Ink jet printers are commonly used worldwide. Such printers utilize cartridges containing ink. Printing is accomplished by ejecting ink through nozzles upon paper or other media forming images in black and color.

When an ink jet cartridges is removed from a printer, stored or shipped ink will dry plugging orifices in the nozzle plate unless an effective seal is applied. An effective seal accommodating a variety of ink jet cartridges preventing ink drying would be beneficial.

Several types of ink jet cartridge storage and seal containers have peen proposed, for example, U.S. Pat. No. 6,199,973 to Bartolome et al. (2001) [storage container for four carts], U.S. Pat. No. 6,062,683 to Kawakami et al. (2000) [storage container], U.S. Pat. No. 5,926,196 to Sawicki et al. (1999) [storage container], U.S. Pat. No. 5,373,936 to Kawai et al. (1994) [storage container]; however these containers are limited to cartridge size and shape they are designed for. In U.S. patent 5, Ink Jet Cartridge Face Sealing For Shipping], a removable seal is proposed requiring application 262,802 to Karita et al. (1993) [clip] and U.S. Pat. No. 5,648,802 to Tsutomu (1997) [cap for an ink jet recording head], a recording head assembly with single sealing member is proposed however is designed for use with a specific recording head assembly. In U.S. Pat. No. 5,400,060 to Carlotta (1995) [Thermal of heat to mold hot melt material to the face of a printhead.

In conclusion, insofar as I am aware, no ink jet printhead seal formerly developed for use when an ink jet cartridge is shipped, stored or removed from a printer that provides an easy to install printhead seal which will seal moist nozzle plates accommodating black, color, different size ink jet cartridges and does not require installation equipment.

OBJECTS AND ADVANTAGES

Accordingly, several objects and advantages of the present invention are:

a) to provide an ink jet cartridge printhead seal whose use will provide an air tight nozzle plate seal;

b) to provide an ink jet cartridge printhead seal which can be used on different size and shape cartridges;

c) to provide an ink jet cartridge printhead seal which will seal both black and color cartridges;

d) to provide an ink jet cartridge printhead seal which will prevent color cartridge cross contamination;

e) to provide an ink jet cartridge printhead seal which can seal a moist printhead surface;

f) to provide an ink jet cartridge printhead seal whose use allows ink jet cartridges to be shipped or stored without ink leaking or drying.

Further objects and advantages are to provide an ink jet cartridge printhead seal which can be easily, conveniently and reliably applied. Still further objects and advantages will become apparent from a consideration of the ensuing description and drawings.

SUMMARY

In accordance with the present invention an ink jet cartridge printhead seal, comprises an elastomeric seal and a flexible sheet with an adhesive on one side which holds the seal compressed against an ink jet cartridge printhead nozzle plate to prevent ink drying when shipped, stored or removed from a printer.

DRAWINGS

Drawing Figures

Figure 1A:
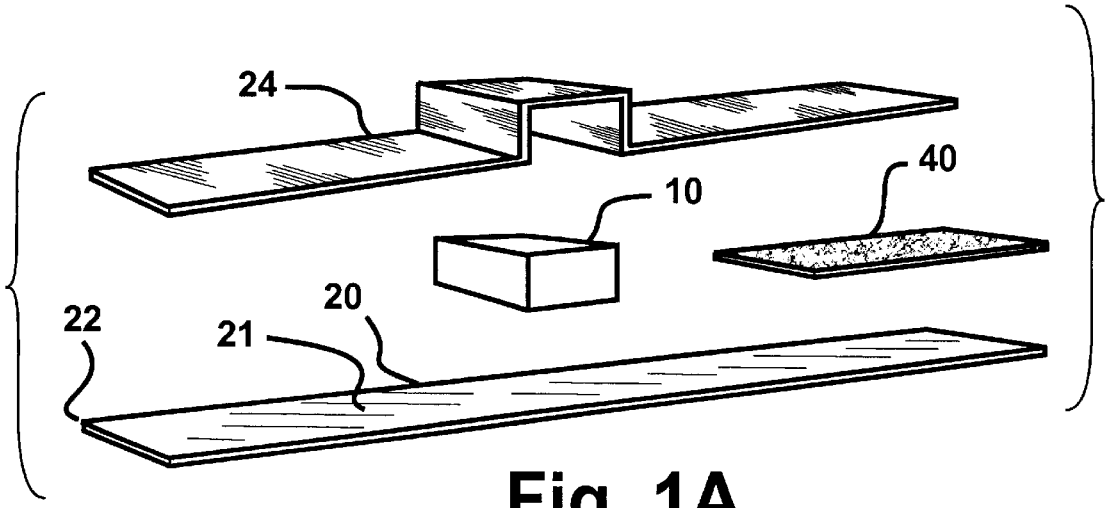
FIG. 1A is an exploded perspective view showing the component parts of the ink jet cartridge printhead seal.

REFERENCE NUMERALS IN DRAWINGS elastomeric seal
flexible material
adhesive
corner
release liner
ink jet cartridge
printhead
nozzle plate
finger tab flexible material finger tab
moisturebarrier
adhesive
lamninate
adhesive

DETAILED DESCRIPTION

Figure 1B:
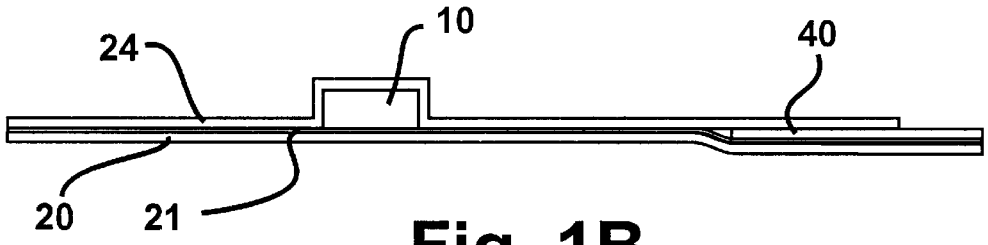
FIG. 1B is a cross-sectional view along a longitudinal axis of the combined ink jet cartridge printhead seal.
Figure 1C:
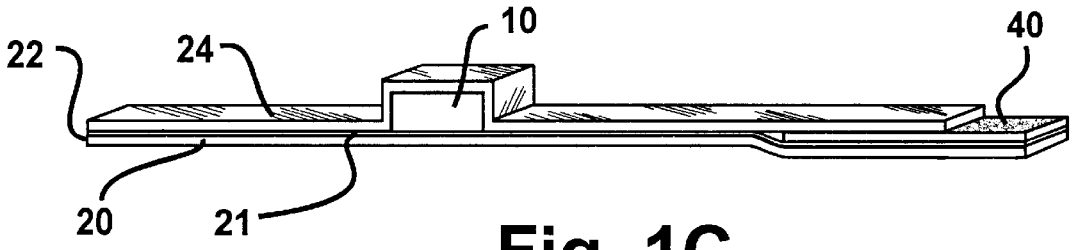
FIG. 1C is a perspective view showing the component parts of the combined ink jet cartridge printhead seal.

Description—FIGS. 1A, 1B and 1C—Preferred Embodiment

A preferred embodiment of the ink jet cartridge printhead seal of the present invention is illustrated in FIG. 1A (exploded perspective view), FIG. 1B (cross-sectional view) and FIG. 1C (perspective view).

As seen in the drawings, the ink jet cartridge printhead seal comprises a strip of flexible material 20 formed of conventional sheet material such as sheet plastic. One surface of the flexible material 20 is coated with a pressure sensitive adhesive 21. Toward one end of the adhesive 21 surface is a finger tab 40 formed of paper. However the finger tab 40 can consists of any other material such as tape, polyethylene, polypropylene, vinyl, nylon, rubber, leather various impregnated or laminated fibrous materials, various plasticized materials, cardboard, etc. An elastomeric seal 10 is laminated to the adhesive 21 surface of flexible material 20. Elastomeric seal 10 is formed of elastic material such as silicone, rubber, vinyl, or any one of a wide variety of resilient materials. The outer surfaces of elastomeric seal 10 are preferably flat, however they may be convex, concave or any other shape or combination of shapes. The elastomeric seal 10 in the preferred embodiment is clear however it may be of any color. A release liner 24 is provided, which is formed of a sheet material having a relatively smooth surface that will bond to an adhesive with bond strength relatively weaker than the bond between the flexible material and the adhesive. Sheet materials such as waxed or otherwise coated or calendered paper, or plastic sheeting may be satisfactorily employed. The outer four corners 22 are typically square, beveled or rounded.

A preferred example as illustrated has been formed utilizing the following materials:

elastomeric seal: clear silicone such as RTV12 provided by GE Silicones of Waterford N.Y.

flexible material: acetate such as 2.0 mil Clear Matte Acetate provided by 3M of St Paul Minn.

adhesive: pressure sensitive acrylic such as 0.7 mil UC-50 Ultra-Clear Acrylic provided by 3M of St Paul Minn.

release liner: paper such as 2.5 mil 40# Densified Kraft—Medium Release provided by 3M of St Paul Minn.

finger tab: paper such as 110 lb. heavy card stock provided by Wausau of Mosinee Wis.

FIGS. 2–4 Additional Embodiments

Figure 2A:
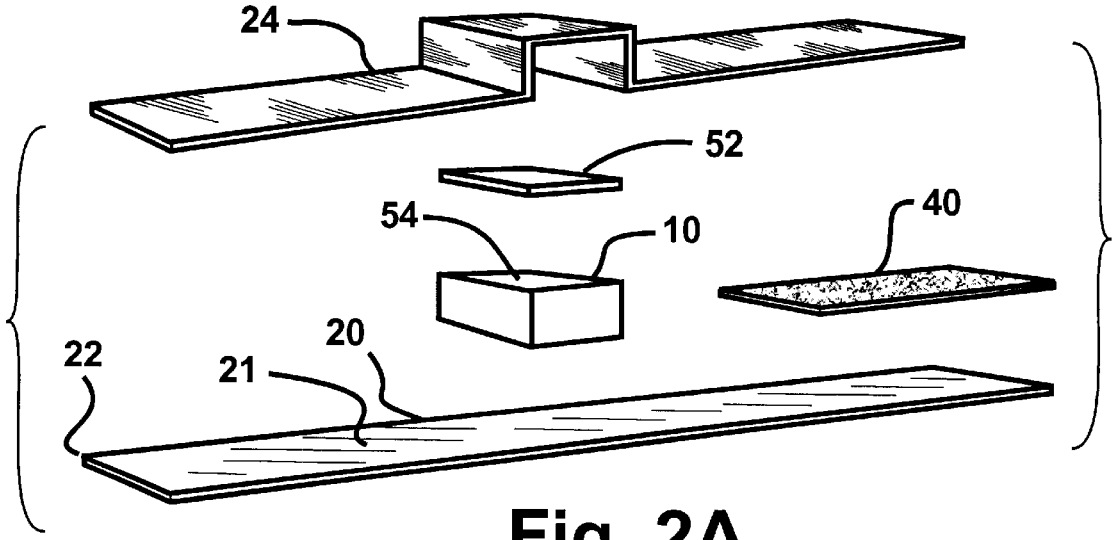
FIG. 2A is an exploded perspective view showing the component parts of the ink jet cartridge printhead seal with an elastomeric seal and moisture barrier.
Figure 2B:
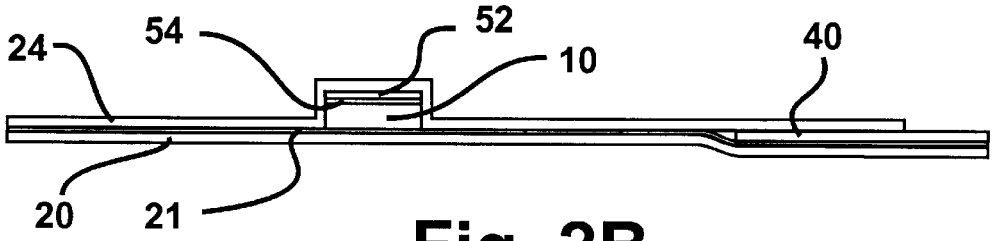
FIG. 2B is a cross-sectional view along a longitudinal axis of the combined ink jet cartridge printhead seal with an elastomeric seal and moisture barrier.
Figure 2C:
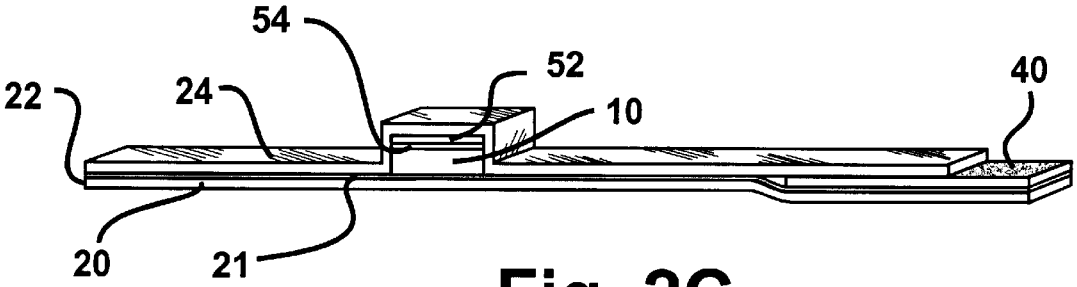
FIG. 2C is a perspective view showing the component parts of the combined ink jet cartridge printhead seal with an elastomeric seal and moisture barrier.
Figure 3A:
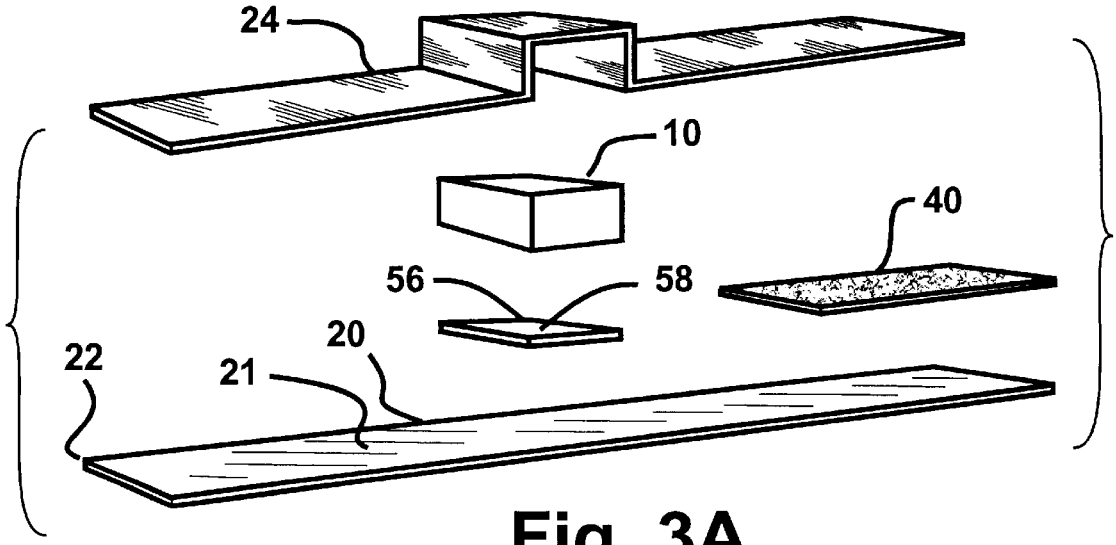
FIG. 3A is an exploded perspective view showing the component parts of the ink jet cartridge printhead seal with a laminate bonded to elastomeric seal.
Figure 3B:
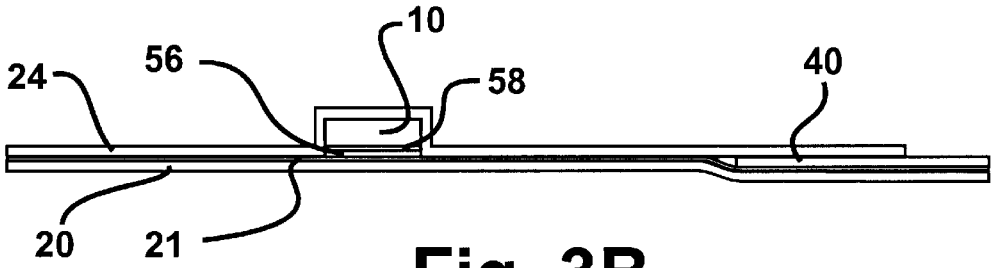
FIG. 3B is a cross-sectional view along a longitudinal axis of the combined ink jet cartridge printhead seal with a laminate bonded to elastomeric seal.
Figure 3C:
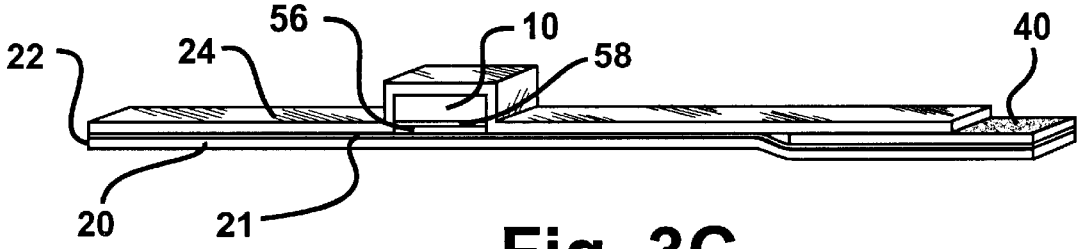
FIG. 3C is a perspective view showing the component parts of the combined ink jet cartridge printhead seal with a laminate bonded to elastomeric seal.
Figure 4A:
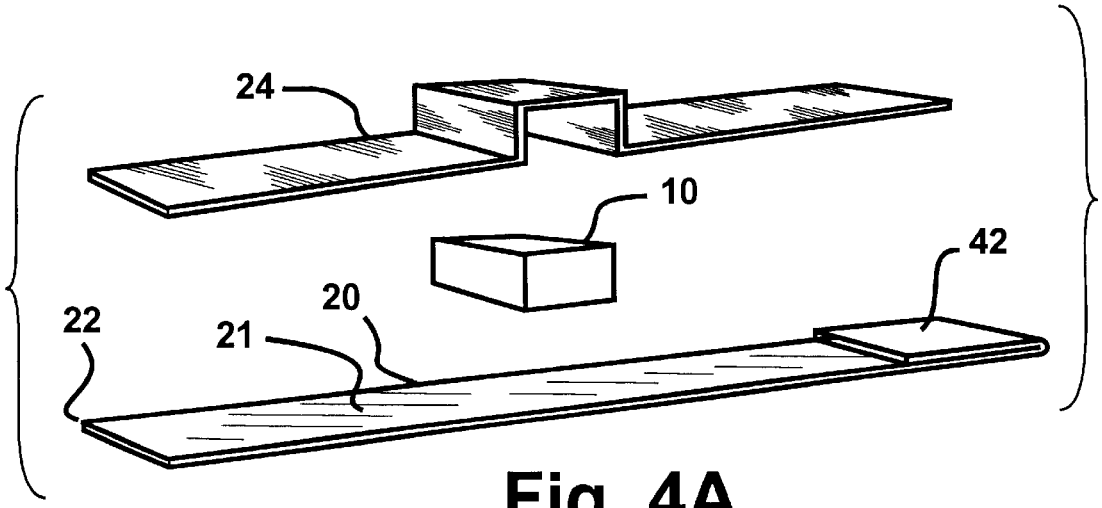
FIG. 4A is an exploded perspective view showing the component parts of the ink jet cartridge printhead seal with a folded flexible material finger tab.
Figure 4B:
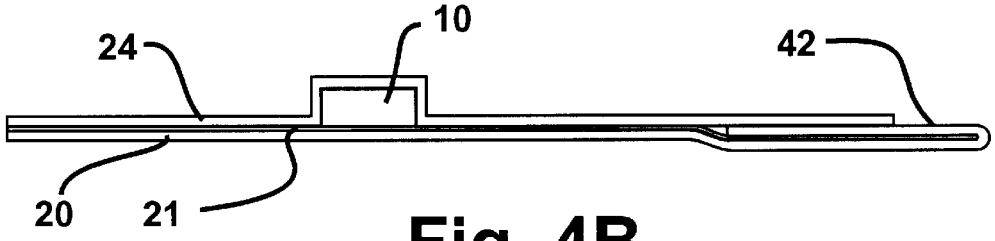
FIG. 4B is a cross-sectional view along a longitudinal axis of the combined ink jet cartridge printhead seal with a folded flexible material finger tab.
Figure 4C:
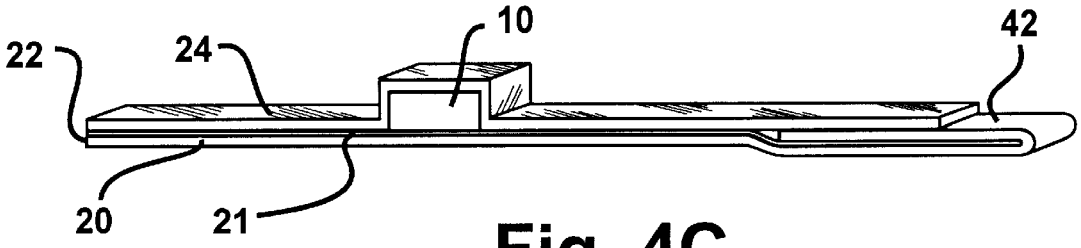
FIG. 4C is a perspective view showing the component parts of the combined ink jet cartridge printhead seal with a folded flexible material finger tab.

Additional embodiments are shown in FIGS. 2A, 2B, 2C, 3A, 3B, 3C, 4A, 4B, and 4C. In FIGS. 2A, 2B and 2C moisture barrier 52 is bonded to elastomeric seal 10 with adhesive 54 or by lamination; in FIGS. 3A, 3B and 3C laminate 56 is bonded to elastomeric seal with an adhesive 58 or by lamination; in FIGS. 4A, 4B, and 4C finger tab 42 is formed by folding flexible material 20 upon itself joining adhesive 21 surfaces.

Figure 5A:
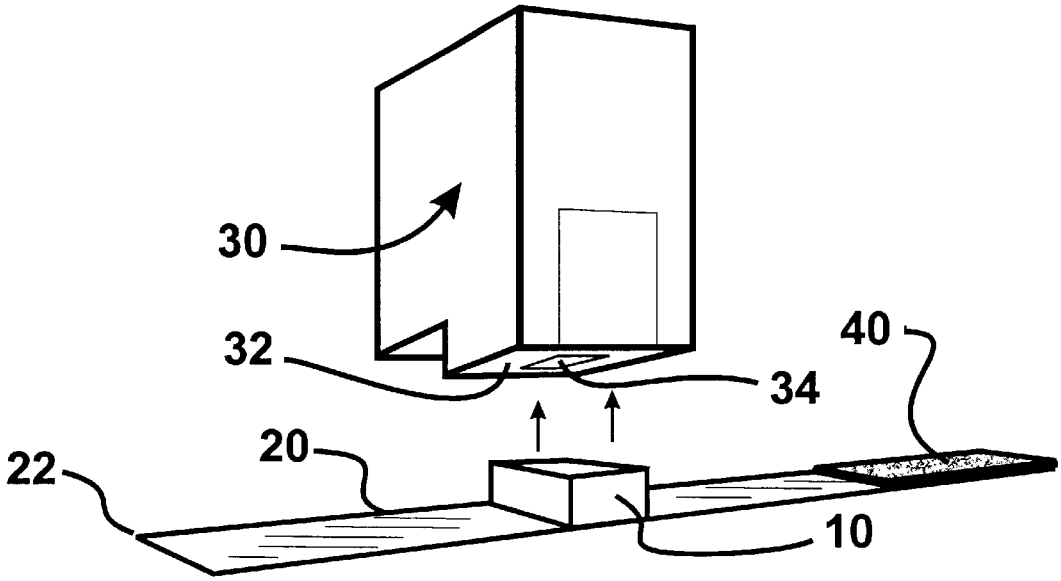
FIG. 5A, 5B and 5C are perspective views of the ink jet cartridge printhead seal applied to an ink jet cartridge printhead.
Figure 5B:
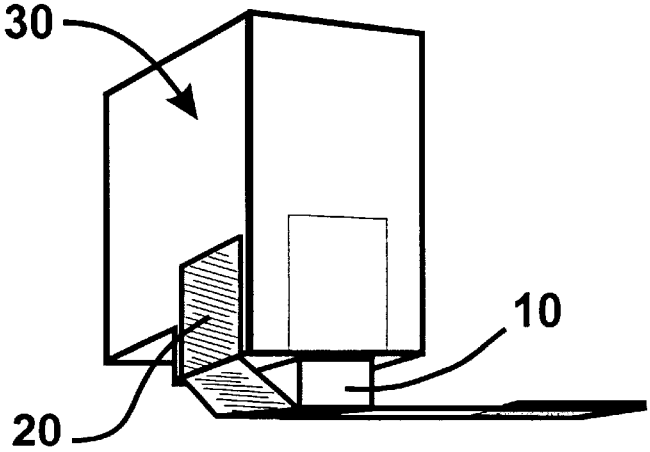
Figure 5C:
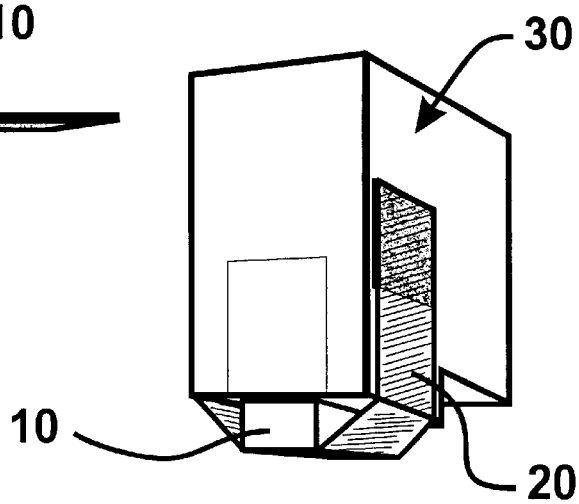

Operation—FIGS. 5A, 5B, 5C

In use, though the above-described components may be hand cut and assembled, they are preferably formed by conventionally available forming equipment with the ink jet cartridge printhead seal, flexible material and release sheet stamped simultaneously.

To install an ink jet printhead seal:

a. remove the release liner from the ink jet cartridge printhead seal;

b. lay the seal on a flat surface and compress the printhead nozzle plate against the seal as shown in FIG. 5A;

c. hold the ink jet seal compressed against the nozzle plate, tension and attach adhesive side of flexible material along each side of the ink jet cartridge as shown in FIGS. 5B and FIG. 5C.

To remove seal, grasp and pull the finger tab to remove the ink jet cartridge printhead seal from the cartridge.

Conclusion, Ramifications, and Scope

Accordingly, the reader will see that the ink jet printhead cartridge seal of this invention can be used to seal ink jet cartridges easily and conveniently. Furthermore, the ink jet cartridge printhead seal has the additional advantages in that:

it provides for shipping or storing ink jet cartridges;

it provides an air tight seal preventing ink drying;

it permits sealing a variety of ink jet cartridges of varying sizes;

it provides a seal for both black and color cartridges;

prevents cross-contamination of color cartridges;

it provides a seal which will work on damp nozzles eliminating the need for drying before application.

Although the description above contains may specificities, these should not be construed as limiting the scope of the invention but as merely providing illustrations of some of the presently preferred embodiments of this invention. It is to be understood, however, that there is no intention to limit the invention to the particular form disclosed. On the contrary, the intention is to cover all modifications, equivalences and alternative constructions falling within the spirit and scope of the invention. Thus the scope of the invention should be determined by the appended claims and their legal equivalents, rather than by the examples given.

What I claim as my invention is:

1. An ink jet cartridge printhead seal comprising:

a sheet of flexible material having an adhesive coating on one face thereof of sufficient size to accommodate attachment to an ink jet cartridge;

an elastomeric seal secured to a said sheet of sufficient size to accommodate an ink jet cartridge nozzle plate;

a release liner overlaying said elastomeric seal and removably secured to the adhesive coating on said sheet for protecting said adhesive;

a finger pull tab at one end of said sheet for removal of said sheet and said seal from said ink jet cartridge.

2. An ink jet cartridge printhead seal as in claim 1, in which a moisture barrier is secured to outer surface of said seal.

3. An ink jet cartridge printhead seal as in claim 1, in which a laminate is secured to base of elastomeric seal.

* * * * *